United States Patent [19]

Giannetti

[11] 4,380,689

[45] Apr. 19, 1983

[54] ELECTROACOUSTIC TRANSDUCER FOR HEARING AIDS

[76] Inventor: Vittorio Giannetti, Via di Vigna Murata 202, 00143 Roma, Italy

[21] Appl. No.: 169,096

[22] Filed: Jul. 15, 1980

[30] Foreign Application Priority Data

Aug. 1, 1979 [IT] Italy ..... 49930 A/79

[51] Int. Cl.[3] ..... H04R 11/00

[52] U.S. Cl. ..... 179/114 R; 179/107 BC; 179/117; 179/121 C

[58] Field of Search ..... 179/107 BC, 114 R, 115 R, 179/117, 119, 120, 121 C, 121 T

[56] References Cited

U.S. PATENT DOCUMENTS 326,675 9/1885 Rogers et al. ..... 179/119 R 2,064,426 12/1936 Greibach ..... 179/115 R 2,291,942 8/1942 Bagno ..... 179/107 BC 2,773,941 12/1956 Christiansen ..... 179/107 BC 3,324,253 6/1967 Uemura et al. ..... 179/115 R 3,573,395 4/1971 Whitmore ..... 179/114 R

*Primary Examiner*—George G. Stellar

*Attorney, Agent, or Firm*—Bacon & Thomas

[57] ABSTRACT

An electroacoustic transducer is disclosed which is small in size so as to allow its use in hearing aids or like structure, but which maintains the performance characteristics of larger transducers. The transducer minimizes its cross-sectional dimensions by aligning the permanent magnet with the soft iron core instead of placing it outside the core. Adjustment of the magnetic flux is provided by a screw trimmer adjustable from the exterior of the transducer.

12 Claims, 3 Drawing Figures

ELECTROACOUSTIC TRANSDUCER FOR HEARING AIDS

This invention refers to an improved electroacoustic button or transducer for hearing aids intended to be used by people whose hearing is impaired.

Such transducers are used in hearing aids for reproducing, as acoustic signals, the electric signals generated by a microphonic device and amplified by a suitable amplifier. Thus, these amplified signals are audible by the person using the hearing aid which is usually comprised in the frame of a pair of spectacles.

Of course these hearing aids, for psychological and aesthetical reasons, must be as small as possible in order to be comprised in a spectacles frame as identical as possible with conventional spectacles frames. Accordingly, hearing aids of this type have been subjected in time to a miniaturing process which, furthermore, has not yet finished.

Particularly, it is still possible to make electroacoustic transducers even smaller and more effective.

Transducers used at present have such a structure as to comprise the necessary cylindrical permanent magnet coaxially located outside of the magnetizable core.

However, this structure is still rather bulky since, due to the necessary minimum dimensions of the components and the indispensable gap between permanent magnet and central core, the cross dimension of this structure cannot be reduced beyond a certain extent, but affecting the performances thereof.

Accordingly, it is the aim of the invention to provide an electroacoustic transducer, the completely new structure of which in respect of already known transducers, allows the transducer cross dimensions to be reduced, should the performances be identical, and better performances to be obtained, should the dimensions be unchanged.

In the electroacoustic transducer of the invention this is obtained by aligning the permanent magnet with the soft iron core instead of placing the same outside the core. Furthermore, the necessary adjustment of the magnetic flux is provided by a screw trimmer, as described in more detail below.

The invention will be now described in more detail with reference to a presently preferred embodiment and a possible modification thereof.

These embodiments are illustrated in the annexed drawings, wherein.

Figure 1:
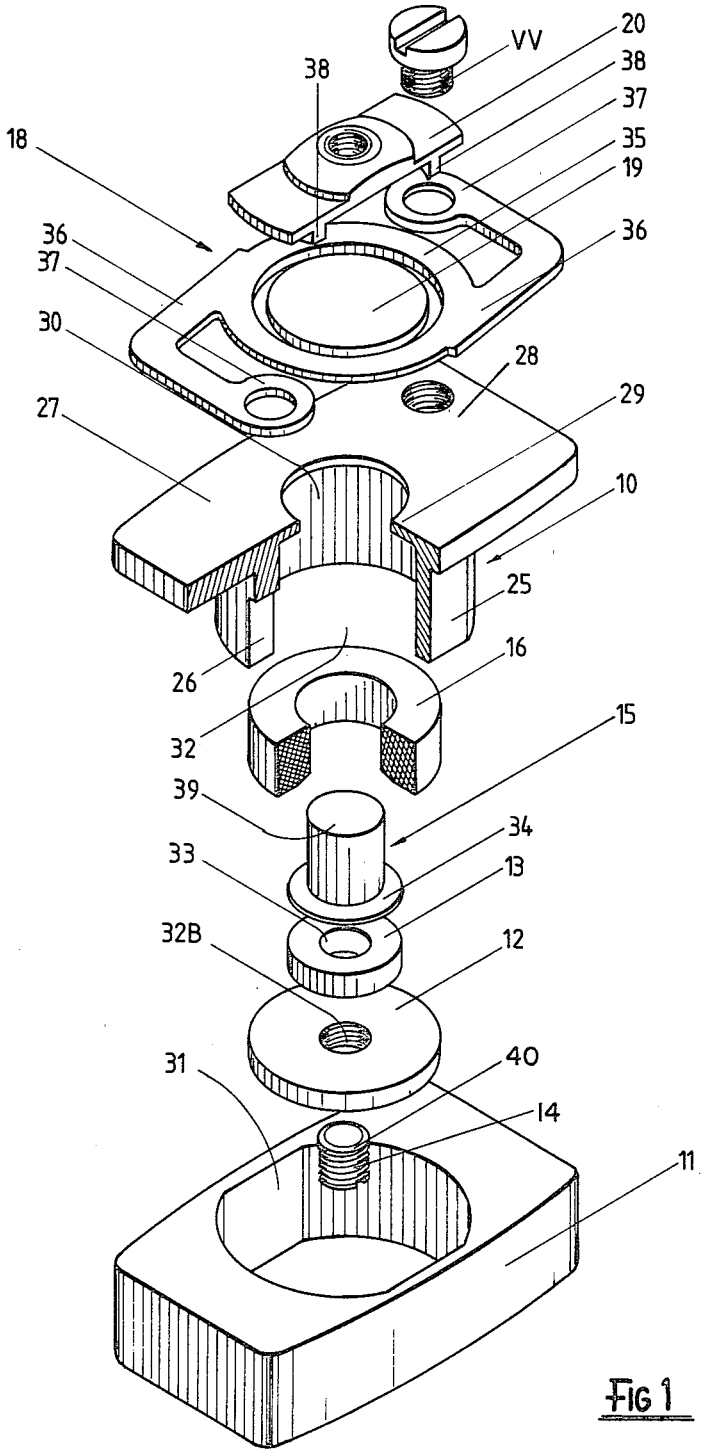
FIG. 1 is an exploded perspective view of the electroacoustic transducer of the invention.
Figure 2:
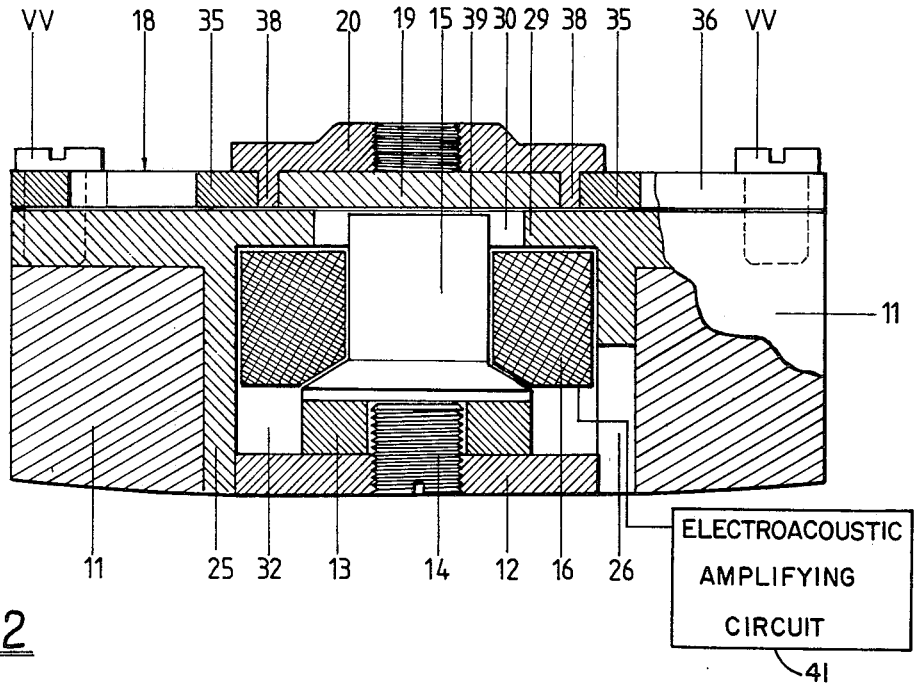
FIG. 2 is an axial sectional view thereof.

Particularly with reference to FIGS. 1 and 2, the improved electroacoustic transducer of the invention substantially comprises: a main support 10; a body 11; a closure disc 12; a permanent magnet 13 having a flat annular shape; an adjusting screw 14; a magnetizable core 15; a winding or coil 16; a support spring 18; a vibrating disc 19; and a blocking plate 20.

Main support 10 is made either from iron or a magnetic alloy and comprises: a cylindrical body 25 presenting a side opening 26; an elongated flange 27 having two threaded holes 28; and, a wall 29 having a central opening 30.

Body 11, which is made from a suitable magnetic material having high specific weight such as lead or brass, has an elongated shape similar to the shape of flange 27, a central bore 31 having a diameter identical with the outer diameter of cylindrical body 25 of support 10 and an outer profile identical with the profile of flange 27. Thus, when assembled within main support 10, body 11 forms an elongated integral body therewith.

Closure disc 12 has a central threaded opening 32B and an outer diameter identical with the diameter of bore 32 of body 25, thus being receivable therein.

Flat annular permanent magnet 13 has a bore 33 coaxial with threaded opening 32B of disc 12. When mounted, permanent magnet 13 is glued or otherwise suitably secured to enlarged base 34 of magnetizable core 15, base 34 having the same diameter as magnet 13.

Adjusting screw 14 is such as to be threadingly received within threaded opening 32B of closure disc 12 and fitted into bore 33 of permanent magnet 13 which is aligned therewith.

Also winding or coil 16 has an annular shape and its radial dimension is such that winding 16 is placed between cylindrical body 25 of support 10 and the cylindrical body of core 15, as clearly shown in FIG. 2.

Spring 18 comprises a central annular body 35 having two diametrically opposed arms 36 protruding therefrom. Arms 36 are bent at right angle and comprise each an eyelet 37 at the free end thereof.

Vibrating disc 19 has a slightly smaller diameter than annular body 35.

Finally, blocking plate 20 has a substantially rectangular shape and is provided with two arcuated ribs 38 on the lower face thereof.

Arcuated ribs 38 have such a structure as to be received within the edge of annular body 35 of spring 18 and the outer edge of vibrating disc 19. Spring 18, vibrating disc 19 and blocking plate 20 are all joined together by either gluing or welding to form a unit.

When the transducer is assembled, as clearly shown in FIG. 2, spring 18 is secured to support 10 by screws VV received within end eyelets 37 of arms 36 and engaged in threaded holes 28 of tab 27 so that vibrating disc 19 faces opening 30 at a small distance from face 39 of the end of magnetizable core 15 which is received into opening 30.

It should be noted now that assembling plate 20 and vibrating disc 19 on spring 18, through either gluing or welding, allows any lacking of precise flatness of spring 18 to be compensated. This feature also allows a perfect parallelism of vibrating disc 19 with end face 39 of magnetizable core 15 and upper face 28 of tab 27 to be obtained.

Coil 16 is connected to the amplifying circuit of the hearing aid 41 through opening 26 formed in cylindrical body 25 of main support 10.

The electroacoustic tansducer of the invention, herein described and illustrated, can be provided with an adjusting device which is also of new concept in the art.

This device comprises adjusting screw 14 which is made from a magnetic material and then is able to modify the magnetic flux of permanent magnet 13 according to the length of end portion 40 of screw 14 received within bore 33 of permanent magnet 13.

Figure 3:
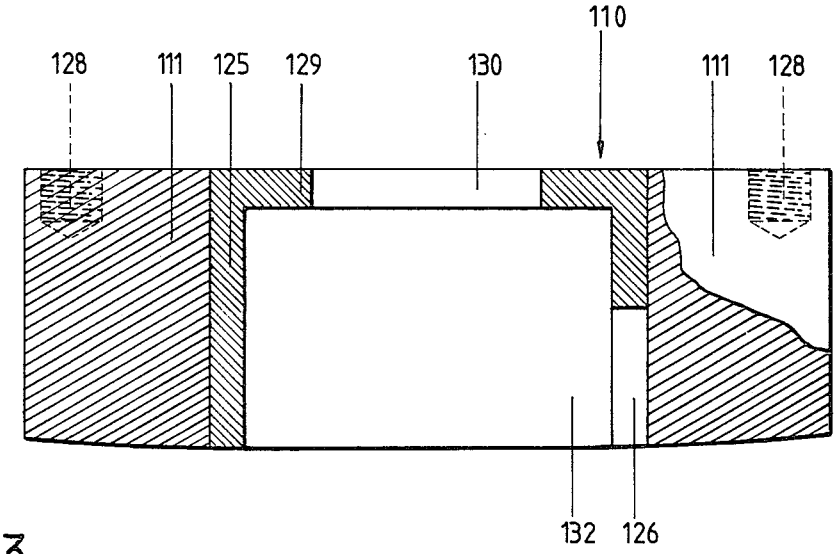
FIG. 3 is an axial sectional view showing the modification of the support for the necessary "vibrating mass".

FIG. 3 shows a modification concerning main support 110 and body 111 which is suitably secured thereto.

In this modified embodiment flange 27 is omitted and spring 18 is threadingly received in body 111 which comprises threaded holes 128 for assembling the spring (not shown).

The operation of the electroacoustic transducer of the invention is identical with the operation of conventional transducers and, accordingly, it will not be described herein.

I claim:

1. An electroacoustic transducer comprising:

(a) a main support having a hollow cylindrical body defining a bore, and a central opening communicating with said bore;

(b) a body defining a central bore and attached to said main support such that said central bore is disposed about said cylindrical body;

(c) a closure disc attached to said cylindrical body across said bore;

(d) an annular, flat permanent magnet located on said closure disc within said bore;

(e) a magnetizable core attached to, and aligned with said permanent magnet;

(f) an electrical winding or coil disposed around said magnetizable core and located between said core and said cylindrical body, said winding or coil being electrically connected to an electroacoustic amplifying circuit;

(g) a vibrating disc;

(h) means attaching said vibrating disc across said central opening in the main support such that it is in close proximity to an end of said magnetizable core; and (i) means to adjustably modify the magnetic flux of said annular, flat permanent magnet.

2. The electroacoustic transducer of claim 1 wherein said closure disc has a threaded opening aligned with the opening in the annular permanent magnet, and said means to adjustably modify the magnetic flux of the permanent magnet comprises an adjusting screw formed of magnetic material threadingly engaged with said closure disc and extending into the opening in the annular permanent magnet.

3. The electroacoustic transducer according to claim 2, wherein said main support has an outer elongated flange extending from said cylindrical body, the flange having a profile indentical with the profile of said body defining a central bore.

4. The electroacoustic transducer of claim 3 wherein said means to attach said vibrating disc comprises:

(a) a support spring having an opening therethrough in which said vibrating disc is located; and, (b) a blocking plate attached to said support spring and said vibrating disc.

5. The electroacoustic transducer according to claim 4, wherein said support spring is secured to said outer flange of said main support.

6. The electroacoustic transducer according to claim 4, wherein said spring, said vibrating disc and said blocking plate are all glued together to form a unit.

7. The electroacoustic transducer according to claim 4, wherein said spring, said vibrating disc and said blocking plate are all welded together to form a unit.

8. The electroacoustic transducer of claim 1 or 2 wherein said means to attach said vibrating disc comprises:

(a) a support spring having an opening therethrough in which said vibrating disc is located; and, (b) a blocking plate attached to said support spring and said vibrating disc.

9. The electroacoustic transducer according to claim 8, wherein said support spring comprises an annular body having said opening for receiving said vibrating disc and two protruding arms provided with eyelet means to receive securing screws.

10. The electroacoustic transducer according to claim 8, wherein said support spring is secured to an outer face of said body defining a central bore.

11. The electroacoustic transducer according to claim 8, wherein said spring, said vibrating disc and said blocking plate are all glued together to form a unit.

12. The electroacoustic transducer according to claim 8, wherein said spring, said vibrating disc and said blocking plate are all welded together to form a unit.

* * * * *